United States Patent [19]

Peterson

[11] 3,945,447

[45] Mar. 23, 1976

[54] BORING APPARATUS

[75] Inventor: Carl R. Peterson, Boxford, Mass.

[73] Assignee: Rapidex, Inc., Gloucester, Mass.

[22] Filed: Sept. 16, 1974

[21] Appl. No.: 506,021

[52] U.S. Cl. ..... 175/349; 175/334; 175/337; 175/345; 175/376; 175/378

[51] Int. Cl.[2] ..... E21B 9/24

[58] Field of Search ..... 175/344–350, 175/354, 355, 376–378, 334, 335, 337

[56] References Cited

UNITED STATES PATENTS

| | | | |
|---|---|---|---|
| 930,758 | 8/1909 | Hughes | 175/353 X |
| 1,302,058 | 4/1919 | Layne | 175/345 X |
| 2,029,770 | 2/1936 | Grant | 175/346 |
| 2,093,603 | 9/1937 | Ellingsen | 175/347 |
| 2,122,863 | 7/1938 | Howard et al. | 175/377 X |
| 2,126,145 | 8/1938 | Smith | 175/346 |
| 2,499,630 | 3/1950 | Clark | 175/346 X |
| 2,915,291 | 12/1959 | Gulfelt | 175/348 |
| 3,018,835 | 1/1962 | Kucera | 175/378 |
| 3,306,379 | 2/1967 | Kloesel et al. | 175/345 |
| 3,306,381 | 2/1967 | Garrett et al. | 175/346 |
| 3,419,093 | 12/1968 | Lichte et al. | 175/376 X |
| 3,726,350 | 4/1973 | Pessier | 175/378 X |
| 3,805,901 | 4/1974 | Coski | 175/344 X |
| 3,820,613 | 6/1974 | White | 175/345 X |
| R27,781 | 10/1973 | Garrett | 175/345 X |

*Primary Examiner*—David H. Brown

[57] ABSTRACT

In boring apparatus of the type having cutters mounted for rotation about respective cutter axes in a frame which is in turn rotatable about a frame axis, each cutter having a body carrying teeth which in operation sweep a surface which is oblique to the axis of advance of the apparatus, that improvement wherein each cutter has selected tooth regions, preferably of alternating high and low tooth densities, spaced along the respective cutter axis, the tooth regions of the cutters are arranged in an ordered cycle progressing along the frame axis, and regions adjacent each other in the cycle are on different cutters and overlap each other along the frame axis.

14 Claims, 11 Drawing Figures

FIGURE 1
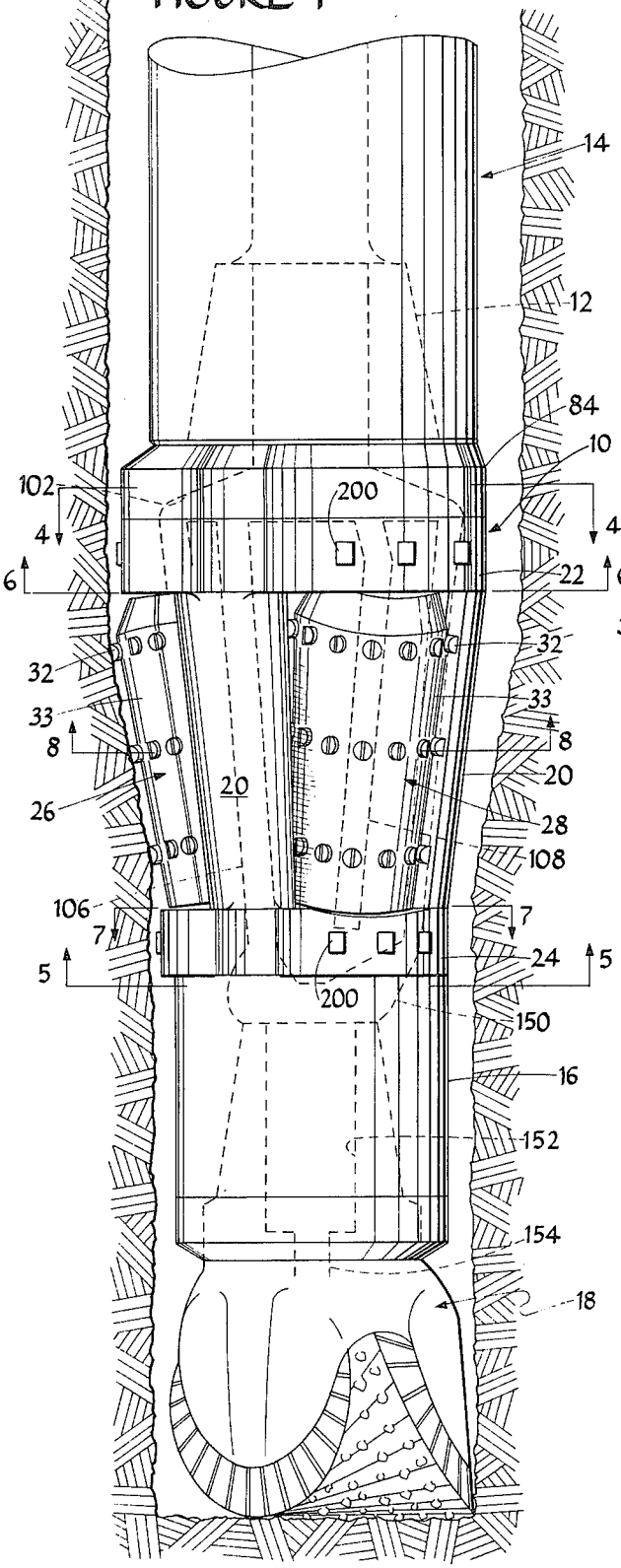
FIGURE 2
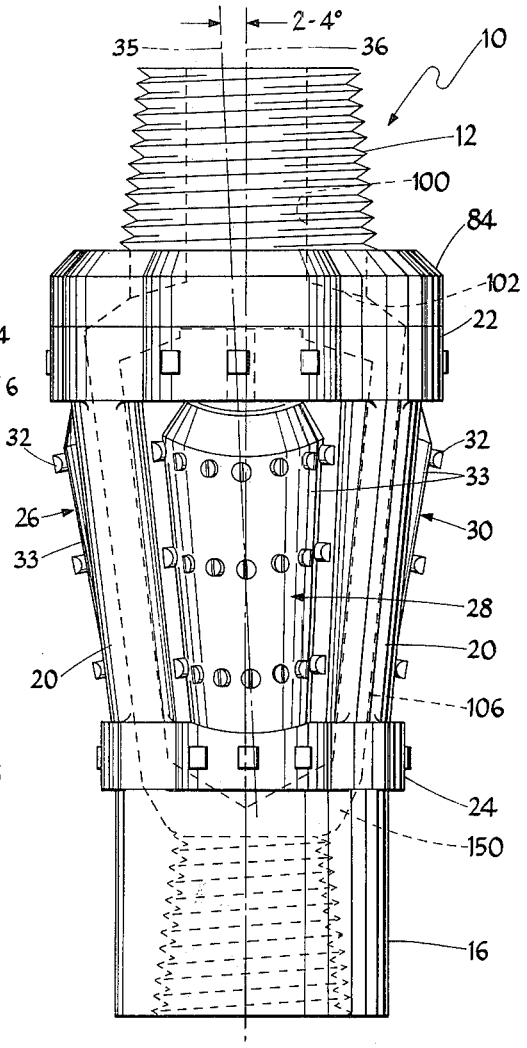
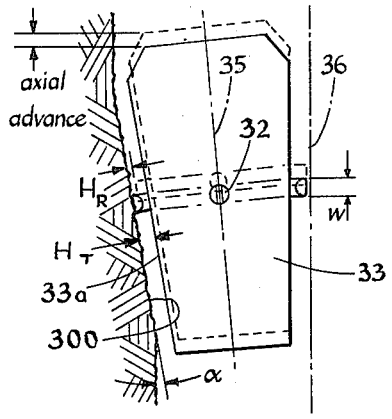
FIGURE 10

BORING APPARATUS

BACKGROUND OF THE INVENTION

This invention relates to the distribution of cutting teeth in boring apparatus useful, e.g., in earth or rock, and in particular in such apparatus in which the surface swept by the teeth during operation is oblique to the direction of overall advance of the apparatus, as in the generally conically shaped apparatus disclosed in my copending patent application Ser. No. 448,245, filed Mar. 5, 1974, now U.S. Pat. No. 3,897,837, the disclosure of which is hereby incorporated by reference.

SUMMARY OF THE INVENTION

This invention, it its various aspects, provides highly efficient cutting, without substantial formation of rock ridges (either circumferential, i.e. extending in the general direction of cutter rotation, or axial, i.e. extending in the general direction of overall advance of the apparatus) such as would increase the required cutting forces or interfere with the cutter body. Tool life is extended, and wear is balanced. Chip size tends to be uniform. As a result of the low cutting forces required, the cutters can be skewed to make the apparatus self-advancing.

In general, the invention features, in boring apparatus of the type having cutters mounted for rotation about respective cutter axes in a frame which is in turn rotatable about a frame axis, each cutter having a body carrying teeth which in operation sweep a surface which is oblique to the axis of advance of the apparatus, that improvement wherein each cutter has selected tooth regions spaced along the respective cutter axis, the tooth regions of the cutters are arranged in an ordered cycle progressing along the frame axis, and regions adjacent each other in the cycle are on different cutters and overlap each other along the frame axis. In another aspect, the invention features a plurality of selected tooth regions arranged in an ordered cycle progressing along the frame axis, and the regions, taken in order in the cycle, have alternately high and low effective tooth densities to counteract the tendency of teeth of one region to track the chip spaces left by teeth of the previous region. In preferred embodiments, there are three cutters, and no set of three regions adjacent each other in the cycle contains more than one region from each cutter; each region consists of a single row of teeth arranged circumferentially about the respective cutter axis; the extent of each region in the direction along the surface and in the plane of the cutter axis is less than the tooth height divided by the tangent of the angle between the surface and the axis of advance; each pair of regions which are adjacent each other in the cycle have respective numbers of teeth in the relation $N_{H/2} < N_L < N_H$, where $N_H$ is the number of teeth in the high effective density region of the pair and $N_L$ is the number of teeth in the low effective density region of the pair (preferably $N_{H/1.9} < N_L < N_{H/1.1}$, and even more preferably $N_{H/1.75} < N_L < N_{H/1.25}$); there are three cutters and the cycle proceeds from cutter to cutter, whereby on each cutter, regions of high and low tooth densities alternate along the respective cutter axis; and the cutter axes are skewed relative to the frame axis, are equally angularly spaced thereabout, and slant to cause the overall envelope of the apparatus to taper along the cutters.

Other advantages and features of the invention will be apparent from the description and drawings herein of a preferred embodiment thereof.

BRIEF DESCRIPTION OF THE DRAWINGS

FIG. 1 is a side elevation of boring apparatus connected to a fragment of a pipe string;

FIG. 2 is a view similar to FIG. 1, from a different angle, with the pipe string and pilot bit omitted;

FIG. 10 is an enlarged view of a cutter fragment showing a cutting tooth in dashed lines in a first position in the hole being bored, and showing the same tooth in solid lines in a later, axially advanced position.

DESCRIPTION OF THE PREFERRED EMBODIMENT

Figure 3:
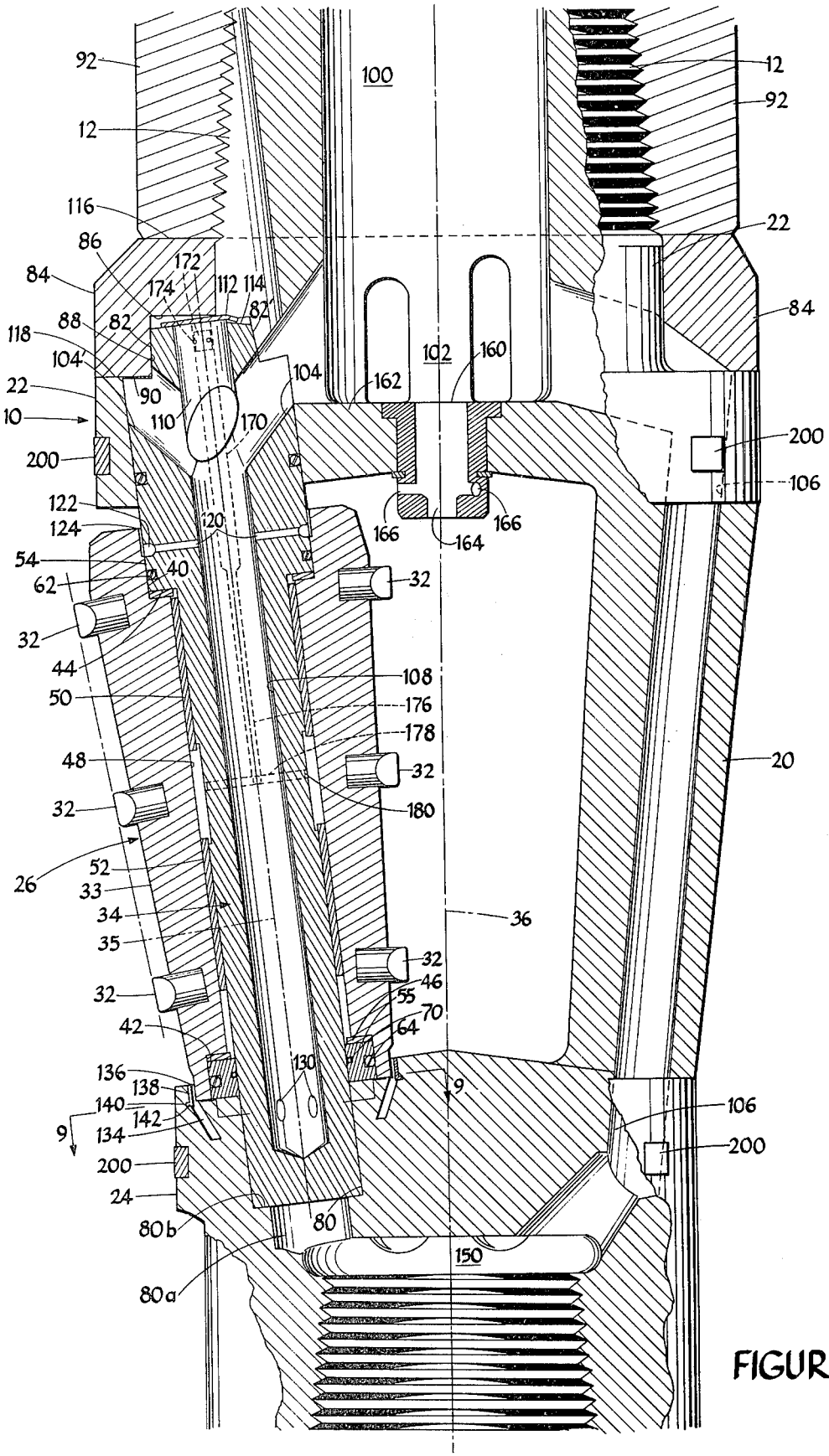
FIG. 3 is an enlarged view of a portion of FIG. 1, partially in section.

Referring to the drawings, there is shown a main frame 10 connected at its top through externally threaded connector 12 to pipe string 14 which extends back to the surface drill rig, and at its bottom through internally threaded connector 16 to conventional tricone pilot bit 18. Frame 10 tapers from top to bottom along three circumferentially spaced struts 20 extending between upper and lower frame portions 22 and 24. Three cutters 26, 28, and 30 are respectively arranged between struts 20.

Figure 11:
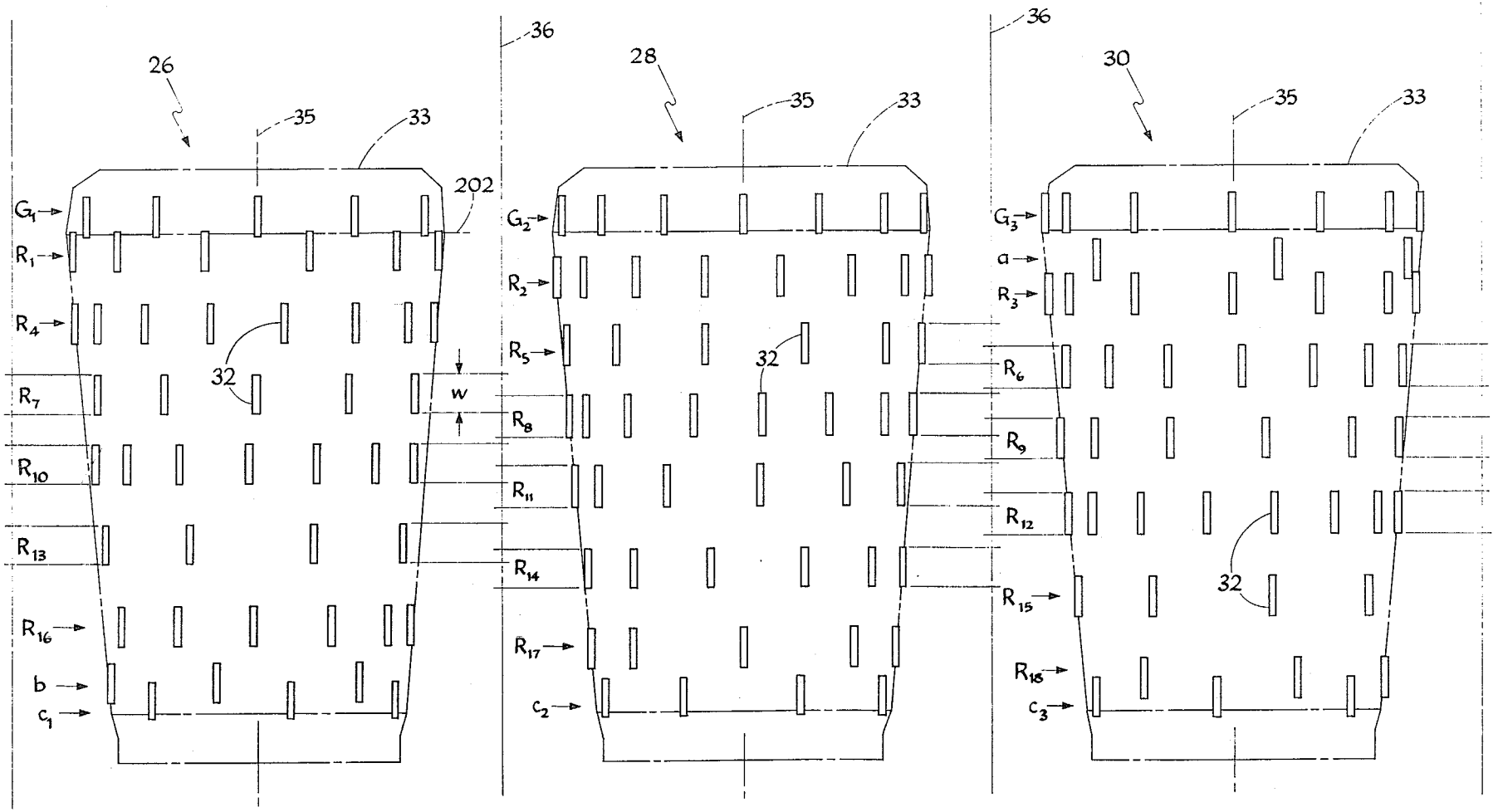
FIG. 11 is a layout of three cutters showing one example of a tooth distribution according to the invention.

Each cutter has tooth inserts 32 in a body 33 mounted to rotate about shaft 34 (FIG. 3) having an axis 35 which not only generally follows the taper of struts 20 but is also skewed (e.g., by 2°–4°, FIG. 2) with respect to the vertical axis 36 of frame 10. The tooth distribution shown in FIG. 1–3 is schematic and not that of the present invention, which is shown in FIG. 11. In overall operation rotation of frame 1 causes cutters 26, 28, and 30 to rotate and to enlarge the pilot hole produced by bit 18. The skew of the cutters produces vertical force components between the hole wall and the cutters, causing the apparatus to be at least partially self-advancing.

Body 33 is tapered where it receives inserts 32, and has fixed itself in counterbores 40 and 42 annular upper and lower thrust bearings 44 and 46 and, on the inside cylindrical surface of its central bore 48, axially spaced radial bearing inserts 50 and 52. The upper bearing 44 runs against enlarged upper portion 54 of shaft 34, which acts as a thrust collar integral with the shaft. Lower thrust bearing 46 runs against a thrust collar 55 inserted in cutter body counterbore 42 and pinned (not shown) to the shaft to prevent rotation of the collar about the shaft while allowing relative axial movement between collar and shaft. O-rings 62 and 64 respectively provide the primary dynamic seals between stationary collars 54 and 55 and the rotating cutter body. Static seal 70 is provided between the collar 55 and shaft 34, to keep dirt out of the internal system and to hold lubricant in. The location of the thrust collars within counterbores in the ends of the cutter bodies minimizes the overall length of the assembly, including the length of the struts and shafts, thereby increasing strength.

Figure 4:
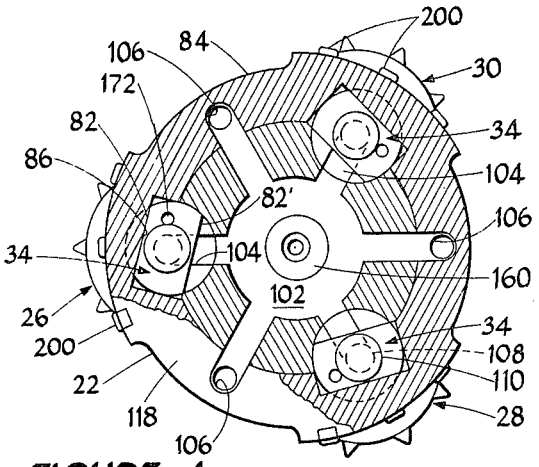
FIGS. 4–8 are sectional views taken respectively along 4—4, 5—5, 6—6, 7—7, and 8—8 of FIG. 1.
Figure 6:
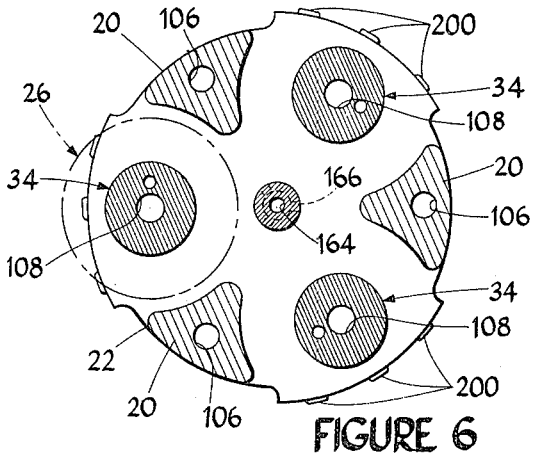
Figure 5:
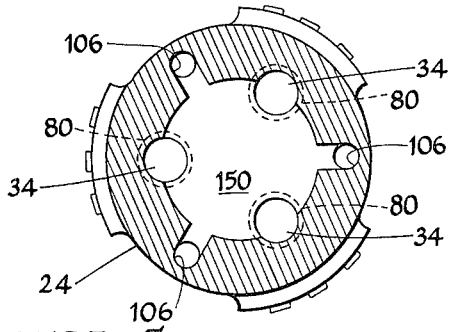
Figure 7:
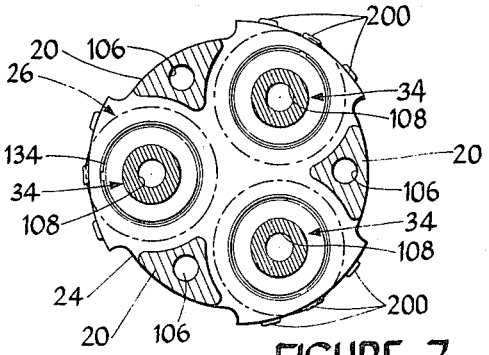

The lower ends of shafts 34 extend into cylindrical bores 80 in frame portion 24. The upper shaft ends are notched at 82 (and at 82', to allow for 180° rotation of the shaft after wear) to receive generally annular retainer collar 84, which holds all three shafts in place and prevents them from rotating. In particular, collar 84 has three pockets 86 (FIG. 4) to receive the notched shaft ends, collar surfaces 88 acting against the shaft flats to prevent shaft rotation. Collar 84 is press fitted around frame portion 22 just below connector 12. Threaded pipe string portion 92 screwed on connector 12 acts as a hold down, pressing collar 84 against the shafts and frame portion 22.

Provision is made for supplying flushing fluid (e.g., air, clear water, or mud, etc.) to pilot bit 18 and to cutters 26, 28, and 30, to flush the rock removed during the drilling process. Thus, axial fluid inlet passage 100 communicates with a diagonal inlet 104 in each shaft 34 and an axial passage 106 in each strut 20. (Each shaft 34 has a second inlet 104' for use when the shaft is rotated.) Inlet 104 in turn feeds axial passage 108 within the shaft. Passages 108 dead end at the bottoms of the shafts. Plug 110 (FIG. 3) fits (without sealing) in the top of passage 108, and is cut off obliquely at its lower end extending into inlet 104. Rotation of the plug changes the effective flow cross-section between inlet 104 and passage 108, thus metering the rate of fluid flow to passage 108. Cap 112 on plug 110 can be indented into recess 114 in the end of shaft 34 to fix the angular position of the plug once it has been adjusted. Collar 84 seals against the pipe string at 116 and against the frame at 118 to prevent leakage of flushing fluid to the atmosphere.

Passage 108 communicates in the region of thrust collar 54, through radial holes 120 in shaft 34, with generally annular buffer chamber 122 formed in the outer surface of the collar, just above seal 62. A narrow clearance 124 (e.g., 0.005 inch radially) is provided between collar 54 and cutter body 33, communicating with chamber 122 and thus providing for a continuous small escape of fluid from the buffer chamber, so that clean fluid is always kept outside seal 62, despite the dirty environment in which the apparatus operates.

Figure 9:
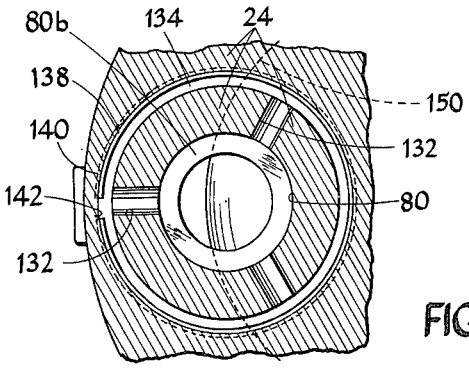
FIG. 9 is a sectional view taken along 9—9 of FIG. 3 with the cutter shafts removed.

Just below thrust collar 55 passage 108 communicates, through radial holes 130 in shaft 34 and aligned radial slots 132 (FIG. 9) in the frame below shoulder 60, with annular buffer chamber 134. Relatively large clearance 136 (e.g., 0.02 inch) is provided between cutter body 33 and frame portion 24, so that a substantial amount of fluid flows through chamber 134 and upwardly past teeth 32. Not only is clean fluid thus kept outside of seal 64, but the cutter is cooled, the conical portion of the hole being drilled is flushed, and the jet pump effect of the upwardly flowing fluid helps to draw upwardly further chips and fluid from the region of the pilot bit. To precisely control the size of clearance 136 (which thus acts as a nozzle), replaceable split ring insert 138 fits in frame portion 24 surrounding (but spaced from) cutter body 33. Flange 140 of ring 138 fits in frame slot 142. The thickness of ring 138 thus determines the nozzle width. The relative rotation between the opposing nozzle-defining walls of clearance 136 gives the nozzle an advantageous self-cleaning quality in use.

Collar 84 seals the tops of strut passages 106, which at their other ends communicate with lower plenum 150. Plenum 150 in turn communicates with axial passage 152 (FIG. 1) and, through that passage, with conventional flushing jets 154 in pilot bit 18. Bores 80 communicate through reduced diameter extensions **80*a* with plenum 150, simply to provide access to the bottoms of shafts 34 (e.g., with a push rod) for disassembly. Shafts 34 rest against shoulders 80b to prevent fluid communicating between bore 80 proper and plenum 150.**

A removable jet fitting 160 extends axially through the bottom wall 162 of plenum 102. The fitting has an axial orifice 164 to project a jet of flushing fluid down the center of frame 10, adjacent the three cutters 26, and three radial orifices 166 to flush between frame wall 162 and the tops of the cutters.

A system for distribution of pressurized lubricant (e.g., grease) is also provided. A grease reservoir 170 (FIG. 3) extends in the wall of each shaft 34, parallel to passage 108. A movable pressure piston 172 is located at the upper end of each reservoir 170, with O-ring 174 providing a seal between the piston and the inner wall of the reservoir. Flushing fluid communicates with the top of piston 172 to pressurize the grease in the reservoir at the flushing fluid pressure. Lube passage 176 extends down from the reservoir, and provides grease through holes 178 to lube grooves 180 at opposite sides of the shaft 34. Grooves 180 may be provided by flats on shaft 34, or may be of any other suitable shape. From grooves 180 the lubricant moves along the outside of the shaft to feed the thrust and radial bearing areas. Seal 70 isolates the lubricant from the atmosphere.

Figure 8:
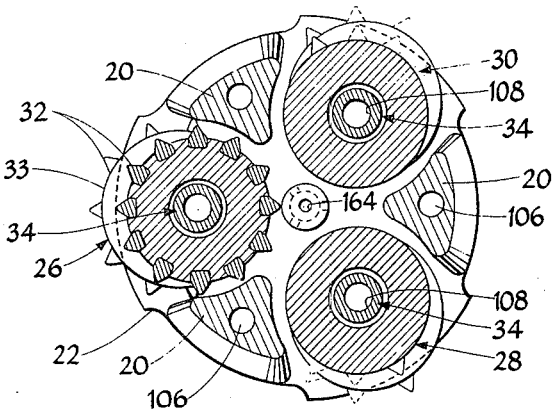

As shown in FIG. 8, upper and lower portions 22 and 24 of frame 10 are of reduced diameter between the positions of the three cutter shafts 34, thus providing, in effect, recesses along which can flow rock cuttings produced by the drilling process. Carbide inserts 200 in the frame periphery at portions 22 and 24 protect the frame against wear.

According to the invention, teeth 32 are distributed in cutter bodies 33 so as to (1) prevent circumferential ridges from building up as the boring progresses, which ridges would have to be climbed by successive teeth and would thus destroy the self-advancing characteristic of the apparatus, and (2) reduce the tendency of teeth to track the chip spaces left by previous teeth and thus cut a "gear", with ridges extending generally in the direction of overall advance of apparatus.

Referring to FIG. 11, the teeth on each cutter body are arranged in circumferential rows about the respective cutter axes 35. The rows $R_1$–$R_{18}$ progress in numbered order in a cycle along the overall axis of advance 36 of the apparatus. In each of these rows the teeth define a tooth region having a width W (shown in the drawings for $R_7$, e.g.) along the cutter body surface. Excluded from the ordered cycle are rows G, and a–c at or near the ends of the cutter, as to which special conditions discussed below apply.

According to one aspect of the invention, all regions $R_i$ and $R_{i+1}$ adjacent each other in the ordered cycle are on different cutters and overlap each other along axis 36. As a result of the overlap, the chip spaces in the rock left by teeth of successive regions will similarly overlap along the vertical axis of the hole being bored, preventing circumferential ridges from forming between tooth regions.

According to another aspect of the invention regions $R_i$, taken in order in the cycle, have alternately high and low effective tooth densities to counteract the tendency of teeth of one region to track the chip spaces left by teeth of the previous region. This prevents gear cutting, by causing the teeth of one region to remove material between the chip spaces left by teeth of the previous regions. Since it is undesirable for one region to have exactly twice (or any other integer multiple) the number of teeth as in an adjacent region (an integer multiple relationship would not prevent chip space tracking), and since it is also desirable to have as many teeth as possible in the low density regions, the preferred arrangement is for adjacent high and low density regions to have respective numbers of teeth $N_H$ and $N_L$ related as follows:

$$N_{H/2} < N_L < N_H.$$

Thus, we may have $N_{H/1.9} < N_L < N_{H/1.1}$; or, even more preferably, $N_{H/1.75} < N_L < N_{H/1.25}$.

At the tops and bottoms of the cutters special requirements will often result in departure from the above relationship. E.g., at the bottom, it is necessary to have teeth in the same axial position on all three cutters so that all may be guided into the pilot hole; and at the top, it is desirable to have virtually as many teeth as possible to minimize wear, since wear of these teeth results in reduction of the bored hole diameter.

Thus, each cutter has at matching axial positions a bottom tooth row $c_1$, $c_2$, $c_3$, and a top row $G_1$, $G_2$, $G_3$. The teeth in rows $G_{1-3}$ are gage teeth located above the cutter body crown line 202, and are inactive until the teeth just below the crown wear, and then act to maintain hole diameter. In addition, extra tooth rows a and b are provided respectively on cutters 30 and 26, for balance.

It should be understood that, within the cycle of regions governed by the overlap and density relationships of the invention, the teeth of a given region need not be in a single circumferential row as shown, but may be staggered relative to the cutter axis.

According to a further aspect of the invention, the width W (i.e., extent along surface 33*a* of body 33) of each tooth region should be limited to avoid excessive ridges and even interference with the cutter body. FIG. 10 shows schematically a cutter in dashed lines in a first, beginning position, and in solid lines in a later position after several revolutions of the cutter. It can be seen that if a row of teeth 32 happens to start a rock gear, a considerable ridge height $H_R$ can be formed before the next tooth row has a chance to break up the axial ridge. Since $H_R$ must remain less than the tooth height $H_T$ (i.e., the distance that the teeth project from the cutter body), and since the maximum $H_R$ that can develop in one tooth width W is $H_R = W \tan \alpha$, where W is the width of the tooth row and $\alpha$ is the angle between the axis 36 and the frusto-conical envelope 300 of the three cutter bodies, a critical requirement is that $$W\ H_T/\tan \alpha$$

In practice it is preferable that the tooth width be well below that critical value.

In the embodiment shown, $\tan\alpha = 0.2$; $H_T = 0.25$; $W = 0.625$; and tooth density and positioning are as follows:

| Row | Distance in Inches of Tooth Centerline Below Crown Line | Number of Teeth | Angular Tooth Spacing | Angular Position of First Tooth |
|---|---|---|---|---|
| $G_1$ | * | 11 | 32°43′12″ | 0° |
| $G_2$ | * | 15 | 24° | 0° |
| $G_3$ | * | 12 | 30° | 0° |

-continued

| Row | Distance in Inches of Tooth Centerline Below Crown Line | Number of Teeth | Angular Tooth Spacing | Angular Position of First Tooth |
|---|---|---|---|---|
| a | .480 | 6 | 60° | 15° |
| $R_1$ | .293 | 11 | 32°43′12″ | 16°21′36″ |
| $R_2$ | .668 | 15 | 24° | 12° |
| $R_3$ | 1.043 | 12 | 30° | 0° |
| $R_4$ | 1.418 | 15 | 24° | 9° |
| $R_5$ | 1.793 | 11 | 32°43′12″ | 21° |
| $R_6$ | 2.168 | 15 | 24° | 3° |
| $R_7$ | 2.543 | 11 | 32°43′12″ | 0° |
| $R_8$ | 2.918 | 15 | 24° | 30° |
| $R_9$ | 3.293 | 11 | 32°43′12″ | 12° |
| $R_{10}$ | 3.668 | 15 | 24° | 21° |
| $R_{11}$ | 4.043 | 11 | 32°43′12″ | 6°16′48″ |
| $R_{12}$ | 4.480 | 15 | 24° | 15° |
| $R_{13}$ | 4.918 | 8 | 45° | 21° |
| $R_{14}$ | 5.355 | 11 | 32°43′12″ | 22°38′24″ |
| $R_{15}$ | 5.793 | 8 | 45° | 18° |
| $R_{16}$ | 6.230 | 12 | 30° | 28°30′ |
| $R_{17}$ | 6.668 | 8 | 45° | 0° |
| $R_{18}$ | 7.105 | 6 | 60° | 25°30′ |
| b | 7.105 | 6 | 60° | 43°30′ |
| $c_1$ | 7.417 | 6 | 60° | 13°30′ |
| $c_2$ | 7.417 | 8 | 45° | 22°30′ |
| $c_3$ | 7.417 | 6 | 60° | 53°30′ |

Other embodiments (e.g., using the tooth distribution of the invention in apparatus of the sort shown in Peterson U.S. Patent Application Ser. No. 441,418, "Mining Machine and Method", filed February 11, 1974, the disclosure of which is hereby incorporated by reference) are within the following claims.

What is claimed is:

1. In boring apparatus of the type having a plurality of cutters mounted for rotation about respective cutter axes in a frame which is in turn rotatable about a frame axis, each said cutter having a body carrying teeth which in operation sweep and cut into a surface which is oblique to the axis of advance of said apparatus, that improvement wherein each said cutter has a plurality of selected tooth regions spaced along the respective said cutter axis, said tooth regions of said plurality of cutters are arranged in an ordered cycle progressing along said frame axis, and regions adjacent each other in said cycle are on different cutters and overlap each other along said frame axis, said regions, taken in order in said cycle, having alternately high and low effective tooth densities to counteract the tendency of teeth of one said region to track the chip spaces left by teeth of the previous said region.

2. The improvement of claim 1 wherein there are three said cutters, and no set of three regions adjacent each other in said cycle contains more than one region from each cutter.

3. The improvement of claim 1 wherein each said region consists of a single row of teeth arranged circumferentially about the respective cutter axis.

4. The improvement of claim 1 wherein the extent of each said region in the direction along said surface and in the plane of the axis of the respective cutter is less than the tooth height divided by the tangent of the angle between said surface and said axis of advance.

5. The improvement of claim 1 wherein said cutter axes are skewed relative to said frame axis and are equally angularly spaced thereabout.

6. The improvement of claim 1 wherein said frame axis and said axis of advance are coincident.

7. In boring apparatus of the type having at least three cutters mounted in a frame which is rotatable about a frame axis, each said cutter having a body carrying teeth which in operation sweep and cut into a surface which is oblique to the axis of advance of said apparatus, that improvement wherein said apparatus has a plurality of selected tooth regions arranged in an ordered cycle progressing along said frame axis, and said regions, taken in order in said cycle, have alternately high and low effective tooth densities to counteract the tendency of teeth of one said region to track the chip spaces left by teeth of the previous said region, said cycle proceeding from cutter to cutter so that on each said cutter regions of high and low tooth densities alternate along the respective cutter axes.

8. The improvement of claim 7 wherein said cutter axes are skewed relative to said frame axis and are equally angularly spaced thereabout.

9. The improvement of claim 7 wherein said cutter axes slant to cause the overall envelope of said apparatus to taper along said cutters.

10. The improvement of claim 7 wherein each pair of said regions which are adjacent each other in said cycle have respective numbers of teeth in the relation $N_{H/2} < N_L < N_H$, where $N_H$ is the number of teeth in the high effective density region of said pair and $N_L$ is the number of teeth in the low density region of said pair.

11. The improvement of claim 10 wherein each $N_{H/1.9} < N_L < N_{H/1.1}$.

12. The improvement of claim 11 wherein each $N_{H/1.75} < N_L < N_{H/1.25}$.

13. The improvement of claim 7 wherein the extent of each said region in the direction along said surface is less than the tooth height divided by the tangent of the angle between said surface and said axis of advance.

14. The improvement of claim 7 wherein said frame axis and said axis of advance are coincident.

* * * * *